US005749025A

United States Patent [19]

Oda et al.

[11] Patent Number: 5,749,025

[45] Date of Patent: May 5, 1998

[54] DOCUMENT-EXPOSING AND -SCANNING APPARATUS

[75] Inventors: Ayumu Oda, Yamatokoriyama; Toshihiro Horiuchi, Nara, both of Japan

[73] Assignee: Sharp Kabushiki Kaisha, Japan

[21] Appl. No.: 690,974

[22] Filed: Aug. 1, 1996

[30] Foreign Application Priority Data

Aug. 1, 1995 [JP] Japan ..... 7-196598

[51] Int. Cl.[6] ..... G03G 21/20; G03G 15/04

[52] U.S. Cl. ..... 399/92; 399/177; 399/211

[58] Field of Search ..... 399/51, 92, 177, 399/200, 202, 208, 211

[56] References Cited

U.S. PATENT DOCUMENTS

| | | | |
|---|---|---|---|
| 4,530,589 | 7/1985 | Adams | 399/92 |
| 4,695,151 | 9/1987 | Watanabe | 399/92 |
| 5,283,614 | 2/1994 | Ookubo | 399/211 |
| 5,504,562 | 4/1996 | Velazquez | 399/92 |

FOREIGN PATENT DOCUMENTS

| | | |
|---|---|---|
| 55-121430 | 9/1980 | Japan . |
| 57-6867 | 1/1982 | Japan . |

OTHER PUBLICATIONS

Comments regarding Japanese applications 55–121430 and 57–6867.

*Primary Examiner*—Sandra L. Brase
*Attorney, Agent, or Firm*—David G. Conlin; John L. Welch

[57] ABSTRACT

A document-exposing and -scanning apparatus designed so that air is blown to act on air-receiving surfaces of an exposing and scanning device through an air duct device placed opposite thereto, to subject the exposing and scanning device to low-friction reciprocating motion in a levitated state, while directing the blown air to the optical scanning section to cool the entire document-exposing and -scanning apparatus.

8 Claims, 15 Drawing Sheets

DOCUMENT-EXPOSING AND -SCANNING APPARATUS

BACKGROUND OF THE INVENTION

1. Field of the Invention

The present invention relates to an apparatus which is used in image-forming apparatuses to expose and scan original images.

2. Description of the Related Art

Document-exposing and scanning apparatuses of the prior art for use in image-forming apparatuses are designed to expose and scan documents, with exposing and scanning means being placed in contact with a guide member so as to be driven by driving means to slide on the guide member. Such apparatuses of the prior art, however, have the problem of producing low-quality images such as distorted images when foreign articles or the like is present on the surface of the guiding member, or the exposing and scanning means is caused to vertically vibrate, induced by vibrations due to operation of the body of the image-forming apparatus. To overcome this problem, some techniques have been presented in an attempt to ensure stable movement of the exposing and scanning means.

For example, Japanese Unexamined Patent Publication JP-A 55-121430 (1980) suggests an apparatus comprising an optical scanning member which is moved by driving means to scan documents, a guide member with an optical scanning member mounted thereon to guide the movement and magnetic means, and which is designed to press the optical scanning member against the guide member through the magnetic force of the magnetic means, thereby attempting to ensure stable scanning.

Japanese Unexamined Patent Publication JP-A 57-6867 (1982) suggests another apparatus which has a guide member, an optical scanning member holding an optical member for scanning documents, and driving means comprising a driving wire for moving the optical scanning member, with the driving wire inclined with respect to the axis of the guide member at the point of connection with the optical scanning member so as to produce a component of tension which presses the optical scanning member against the guide member.

The conventional document-exposing and -scanning apparatuses described in Japanese Unexamined Patent Publication JP-A 55-121430 and Japanese Unexamined Patent Publication JP-A 57-6867 have some considerations in that the exposing and scanning means is pressed against the guide member to prevent the vibration. This, however, has produced an other problem of impairing image quality due to uneven speed resulting from uneven frictional resistance at the sections of contact, and shortening the life of the apparatus, and an additional problem of increasing the driving force of the driving source due to the considerable pressing force exerted on the sections of contact, which leads to an increased size of the driving source and requires a greater power supply.

In addition, since document-exposing and -scanning apparatuses are usually equipped with filament-type light sources which generate heat, continuous exposing and scanning tends to result in abnormal increase of the temperature of a document-laying table, and thus there is a danger that the document may ignite, thereby burning the operator if no measures are taken. Therefore, document-exposing and -scanning apparatuses of the prior art have the drawback of complicated configurations which include cooling devices such as cooling fans provided specifically to prevent an increase in the temperature.

SUMMARY OF THE INVENTION

The document-exposing and -scanning apparatus in the present invention is characterized by comprising a document-laying table for mounting a document thereon; an optical scanning section comprising exposing and scanning means which exposes and scans the document on the document-laying table and is provided with air-receiving surfaces, and drive means for reciprocating the exposing and scanning means in the direction of scanning; and air duct means placed facing the air-receiving surfaces of the exposing and scanning means so as to subject the surfaces to the action of air, extending along the direction of scanning, wherein air is blown through the air duct means to levitate the exposing and scanning means while being directed to the optical scanning section as well.

The document-exposing and -scanning apparatus is further characterized in that the air duct means is constructed of at least two parallel air ducts placed near both ends of the exposing and scanning means, with the ducts being placed so as to blow air in slanting, inward and upward directions, in a converging manner.

The document-exposing and -scanning apparatus is further characterized in that the air duct means has concave or convex sections, and is provided with air spouts formed through the concave or convex surfaces, and the exposing and scanning means has sections matching the concave or convex contour of the air duct means.

According to yet another aspect, the document-exposing and -scanning apparatus of the invention comprising a document-laying table for mounting a document thereon; an optical scanning section comprising exposing and scanning means which exposes and scans the document on the document-laying table and is provided with air-receiving surfaces, and drive means for reciprocating the exposing and scanning means in the direction of scanning; and air duct means placed facing the air-receiving surfaces of the exposing and scanning means so as to subject the surfaces to the action of air, extending along the direction of scanning, is characterized in that the air duct means is formed of a first region for blowing air and a second smooth region on which part of the exposing and scanning means slide, air blown through spouts arranged in the first region of the air duct means acts on the air-receiving surfaces of the exposing and scanning means, the exposing and scanning means undergoes reciprocating motion while part of the exposing and scanning means is placed in contact with the second region, and air blown through the air duct mean is directed to the optical scanning section.

Yet another characteristic aspect of the document-exposing and -scanning apparatus is that each of the air duct means is tubular, and is provided with an adjusting blade for changing the internal air flow area.

Yet another characteristic aspect of the document-exposing and -scanning apparatus resides in the fact that the air duct means is provided with regulating members, which extend along the direction of scanning, to regulate the greatest levitation height of the exposing and scanning means, and the exposing and scanning means undergoes reciprocating motion while part of the exposing and scanning means is placed in contact with the regulating members.

Yet another characteristic aspect of the document-exposing and -scanning apparatus is that the air duct means has additional air spouts for blowing air toward both ends of the exposing and scanning means on the sides thereof.

The exposing and scanning means is characterized by being levitated independently from the driving means.

Since the process of exposing and scanning is carried out while levitating the exposing and scanning means with air, or alleviating force exerted on the guide members according to the invention, it presents a solution to the problem of image impairment due to uneven exposing and scanning speeds resulting from variation in the frictional resistance of the sections of contact which are attributed to pressing of the exposing and scanning means against the guide members, as well as to the problem of a shorter life of the apparatus due to wear at the sections of contact, and it eliminates or alleviates the necessity of increasing the size of the drive source or supplying more electric power to increase the driving force of the drive source against the pressing force exerted on the sections of contact, and overcomes the disadvantage of the complicated configuration resulting from provision of cooling equipment serving only to prevent increase of the temperature.

The invention also allows the process of exposing and scanning to be performed without leaning the exposing and scanning means to either side, since the air duct means comprises at least two parallel air ducts near and along both ends of the exposing and scanning means to control flows of blown air to a constant pressure.

The invention also allows stable, horizontal motion of the exposing and scanning means without strict control of the difference between the volumes of air from the two air ducts, since the two air duct means placed along both ends of the exposing and scanning means have concave or convex sections so as to allow proper location of the exposing and scanning means with the aid of the air duct section at either end.

Also, according to the invention, since the exposing and scanning means is subjected to reciprocating motion by the reciprocating motion-driving means, while air blown through the spouts arranged in the first region of the air duct means for blowing air acts on the air-receiving surfaces of the exposing and scanning means, and the exposing and scanning means slides on the second smooth region, partly in contact therewith, and since air blown through the air duct means is directed to the optical scanning section, the pressure resulting from contact with the regulating members is lower than when the exposing and scanning means is not levitated, and this results in substantial reduction of wear at the sections of contact.

Also, according to the invention, since the two air duct means are tubular and have adjusting blades for changing the internal air flow areas, the respective volumes of air through the air duct means may be adjusted to easily set the standard air volume and keep the volumes of air through the two in balance.

In addition, according to the invention, since the process of exposing and scanning is performed with part of the exposing and scanning means in contact with the regulating members which constitute part of the air duct means and regulate the greatest levitation height of the exposing and scanning means, the sections of contact do not bear the weight of the exposing and scanning means, and this results in lower wear at the sections of contact.

The invention also allows levitation of the exposing and scanning means stabilized in a horizontal position, since the air duct means have air spouts which face both ends of the exposing and scanning means to blow air to the sides thereof.

According to the invention, since the exposing and scanning means is constructed to be levitated independently from the driving means, the levitated, exposing and scanning means performs the exposing and scanning process in a stable levitated state without being influenced by any part (e.g., the drive wires) of the driving means.

BRIEF DESCRIPTION OF THE DRAWINGS

Other and further objects, features, and advantages of the invention will be more explicit from the following detailed description taken with reference to the drawings wherein.

DETAILED DESCRIPTION OF THE PREFERRED EMBODIMENTS

Figure 1:
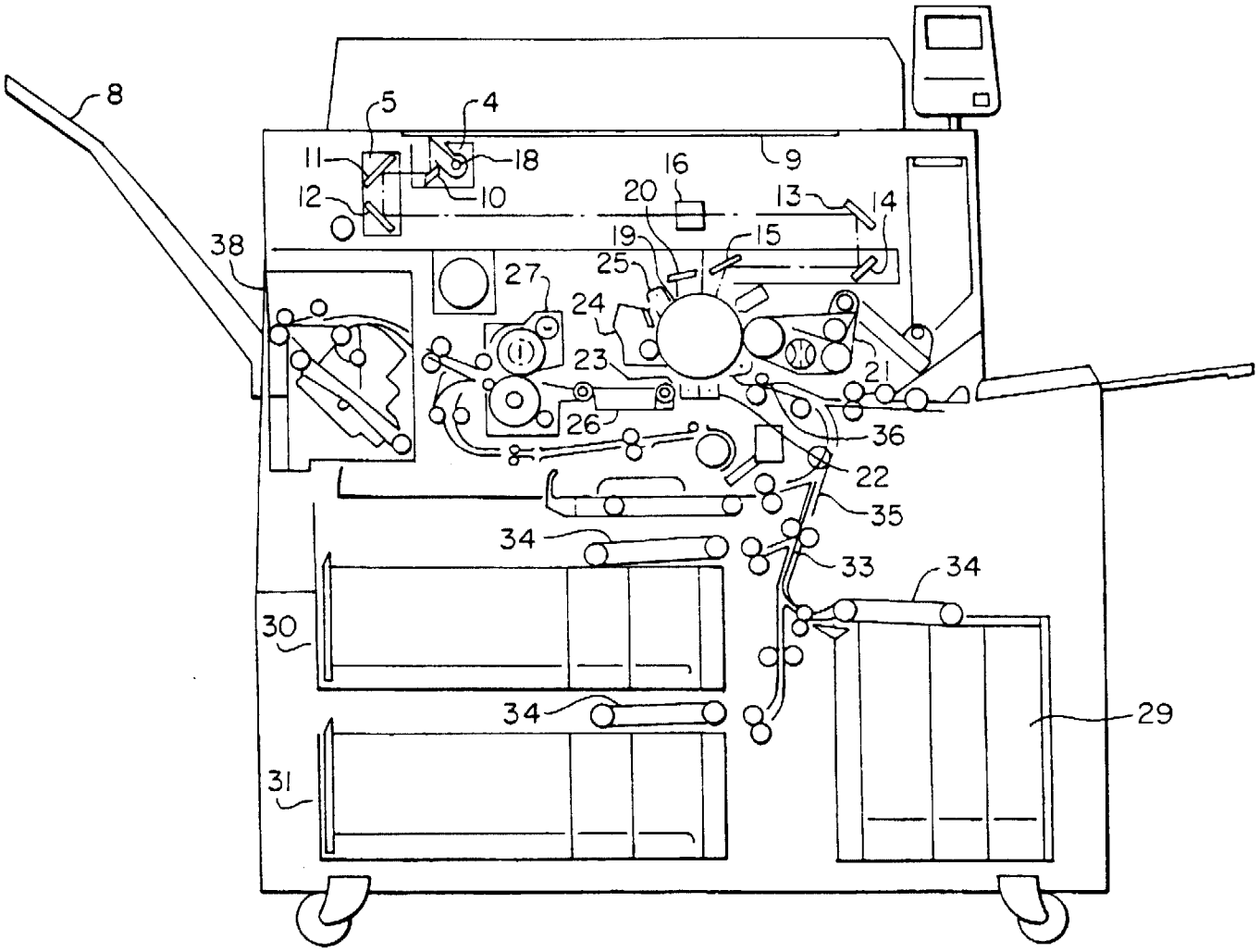
FIG. 1 is a schematic view illustrative of an image-forming apparatus according to the present invention.

Now referring to the drawings, preferred embodiments of the invention are described below.

Brief explanation will first be given of the configuration and the operation of an image- forming apparatus provided with a document-exposing and -scanning apparatus according to the present invention with reference to FIG. 1.

The optical scanning section of the image-forming apparatus comprises an exposure source lamp 18, a mirror unit 4 comprising a first mirror 10, another mirror unit 5 comprising a second mirror 11 and a third mirror 12, a lens 16, a fourth mirror 13, a fifth mirror 14, a sixth mirror 15 and a document-laying table (original glass) 9. The optical scanning section is designed so that the document placed on the document-laying table 9 is horizontally exposed and scanned with the mirror units 4 and 5 so that a document image is projected onto a photoconductor drum 19 through the lens 16 and the respective mirrors to form an electrostatic latent image on the photoconductor drum 19.

Placed along the periphery of the photoconductor drum 19 with the document image projected thereon are a charging device 20, a developing device 21, a transferring device 22, a releasing device 23, a cleaning device 24 and a destaticizing device 25, all of which constitute an image-forming section. The document image formed as an electrostatic latent image is developed as a toner image according to the hitherto known Carlson process with the developing device 21, and is made visible as the toner image.

The sheet-feeding section comprises sheet trays 29, 30 and 31 for holding sheets of various sizes which receive images thereon, and a sheet-feeding device 34 for feeding sheets in the sheet trays 29, 30 and 31, and is designed in such a manner that sheets fed by the sheet-feeding device 34 are conveyed to a timing roller 36 along conveying paths 33 and 35. In order to transfer each visualized document image to the proper position on a sheet, the timing roller 36 is rotated in synchronization with the process of exposing and scanning to feed the sheet to a transfer region between the transfer device 22 and the photoconductor drum 19 to transfer the image onto the sheet by the transfer device 22. The sheet with the transferred image is sent to a fixing device 27 via a conveying belt 26, and is ejected onto a sheet outlet tray 8 via a sheet-ejecting device 38 after the toner image on the sheet has been thermally fixed.

Figure 2:
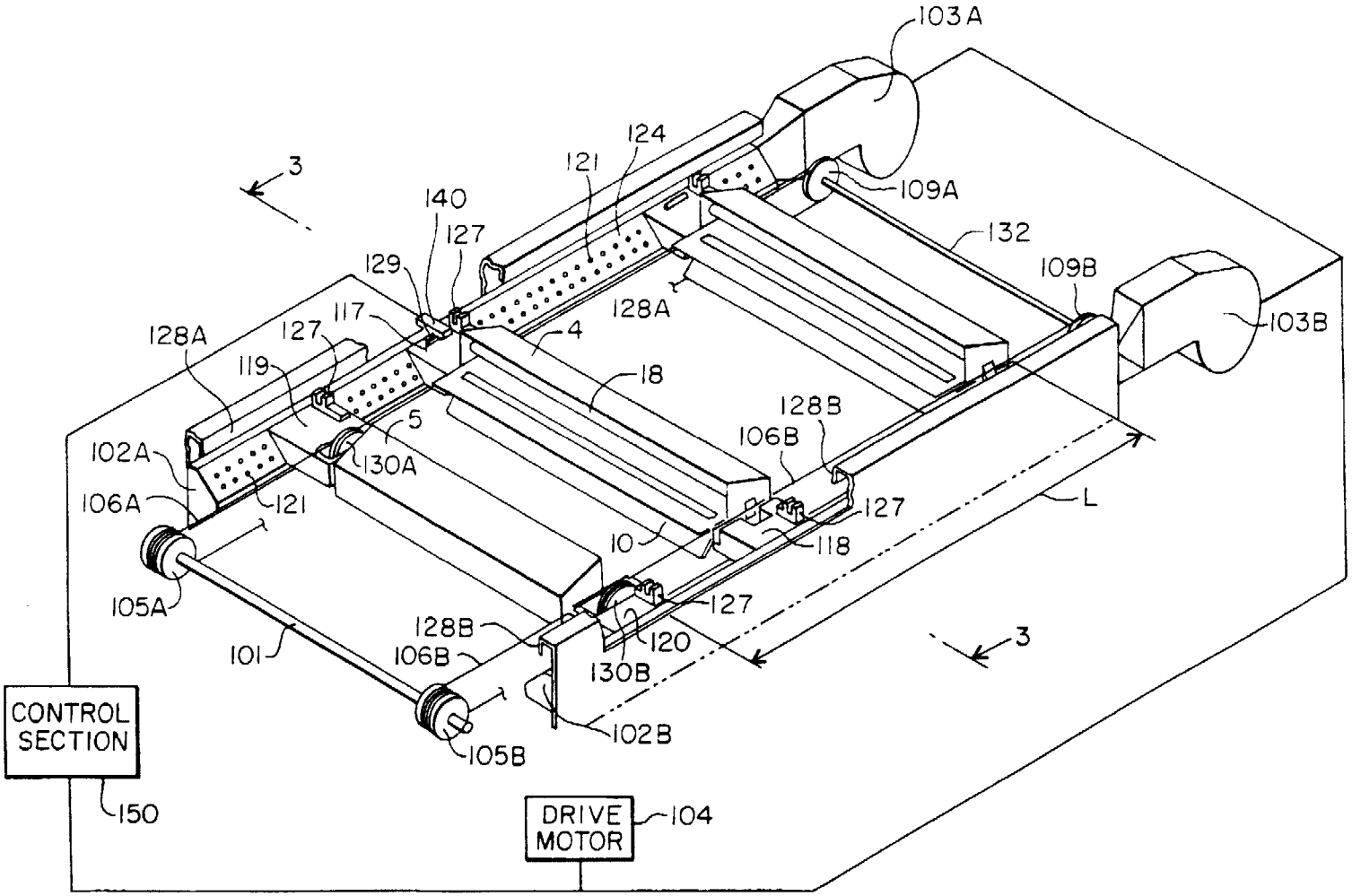
FIG. 2 is a schematic view illustrative of a document-exposing and -scanning apparatus according to the invention.

The configuration of the document-exposing and -scanning apparatus according to the invention will now be explained. FIG. 2 is a schematic diagram illustrative of an embodiment according to the invention, wherein an exposing and scanning means 4 is a mirror unit comprising an exposure source lamp 18 as the light source and a first mirror 10, and another exposing and scanning means 5 is a mirror unit comprising a second mirror 11 and a third mirror 12. Both ends of the respective mirror units 4 and 5 are provided with supporting blocks 117, 118, 119 and 120, and the underside of each of the supporting blocks 117, 118, 119 and 120 has an air-receiving surface 122 (see FIG. 3) for receiving air blown from air spouts 121 through the top surfaces of air duct rails 102A and 102B which are described below.

The supporting block 117 of the mirror unit 4 is provided with a position-detecting section 129 with which the image-forming apparatus recognizes whether the mirror unit 4 is located at its home position on standby for its reciprocating motion. In addition, the supporting blocks 117, 118, 119 and 120 at the ends of the respective mirror units 4 and 5 are provided with levitation height-detecting sensors 127 which are photosensors; upon levitation of the mirror units 4 and 5, height-detecting rails 128A and 128B fixed on the body, along the air duct rails 102A and 102B move into slit sections 127*a* to serve as the detecting sections of the levitation height-detecting sensors 127 to detect whether the mirror units 4 and 5 are normally levitated.

Means for driving the mirror units 4 and 5 comprises a drive motor 104, a pair of parallel drive wires 106A and 106B strung along the direction of scanning, turn pulleys 105A, 105B, 109A and 1O9B around which the drive wires are strung, two-stepped pulleys 130A and 130B supported on the supporting blocks 119 and 120 in a freely rotatable manner, shafts 101 and 132 of the turn pulleys, another two-stepped pulley (not shown) which are connected with the turn pulleys via the drive wires 106A and 106B, and a take-up drum attached to the shaft of the drive motor. The connections between the associated pulleys and drive wires may be established in the same manner as, for example, the publicly known pulley-driving means disclosed in Japanese Unexamined Patent Publication JP-A 57-6867 (FIG. 2). Therefore, the disclosure of Japanese Unexamined Patent Publication JP-A 57-6867 is incorporated herein by reference.

With this configuration, the drive motor 104 is activated under control of a control section 150, to subject the mirror units 4 and 5 to reciprocating scanning in a horizontal direction. Here, since the mirror unit 4 and the mirror unit 5 horizontally travel at a travel velocity ratio of 2:1, when the mirror unit 4 has traveled the length (L) of the exposing and scanning stroke illustrated in FIG. 2, the mirror unit 5 reaches around the midpoint (L/2) of the length.

Figure 6A:
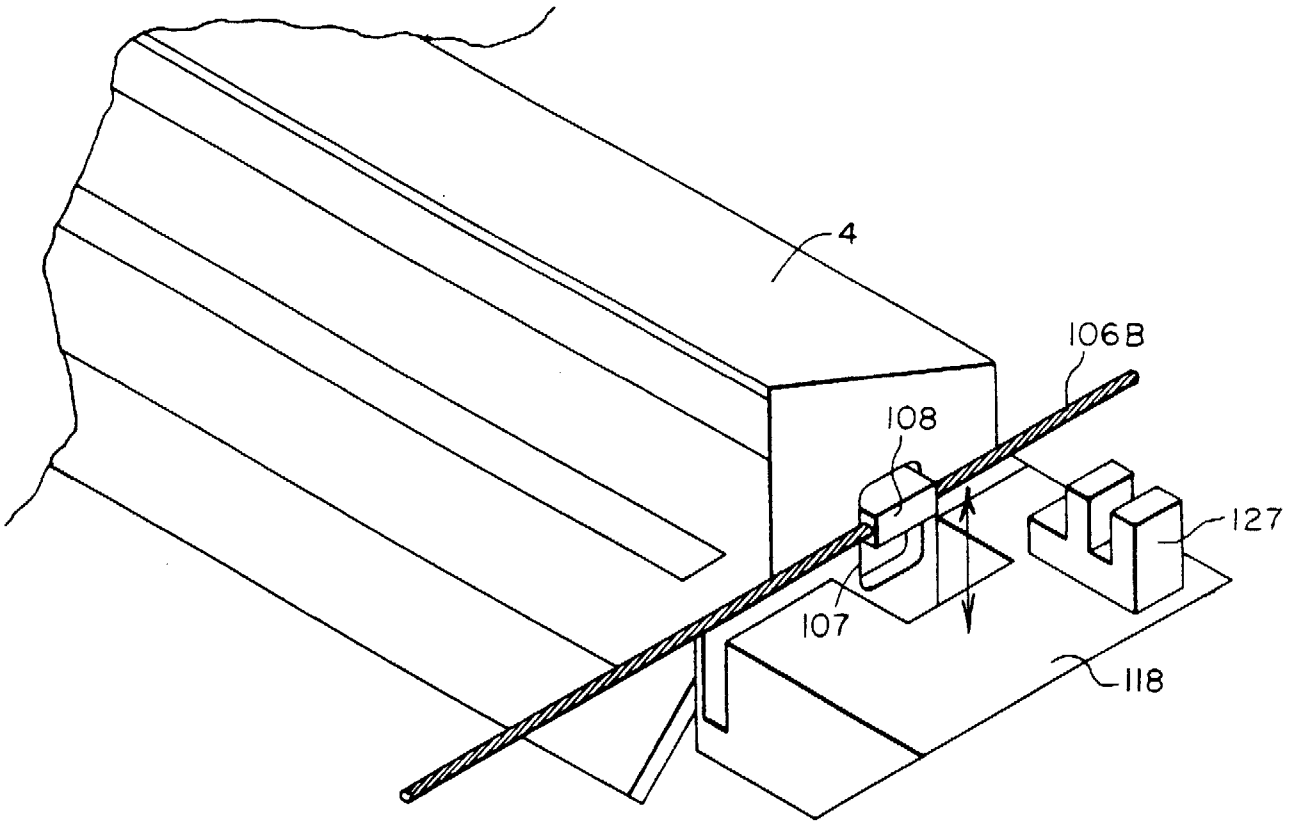
FIG. 6A is a view illustrative of the anchoring sections between the mirror unit 4 and driving means.

As shown in FIG. 6A, an engaging member 108 is provided at sections of engagement between the pair of the drive wires 106A and 106B as the driving means, and the supporting blocks 117 and 118 placed at both ends of the mirror unit 4. The drive wire 106B and the engaging member 108 are fixed to each other, and a rail groove 107 formed in the side of the mirror unit 4 is engaged with the engaging member 108 in such a manner that smooth movement of the rail groove 107 occurs only vertically (in the direction indicated by the double-headed arrow in FIG. 6A). Accordingly, when the mirror unit 4, which is levitable as described later, is levitated, the rail groove 107 moves upward, and thus the engaging member 108 is maintained at a fixed position with respect to the drive wire 106B without being influenced by the levitation of the mirror unit 4. The engaging member 108 remains at the fixed position even after the mirror unit 4 has been released from the levitated state and has come down. This configuration results in no vertical load exerted from the drive wire 106B on the mirror unit 4 even while being levitated, and thus prevents the position of the mirror unit 4 in the direction of levitation from being unstable.

Figure 6B:
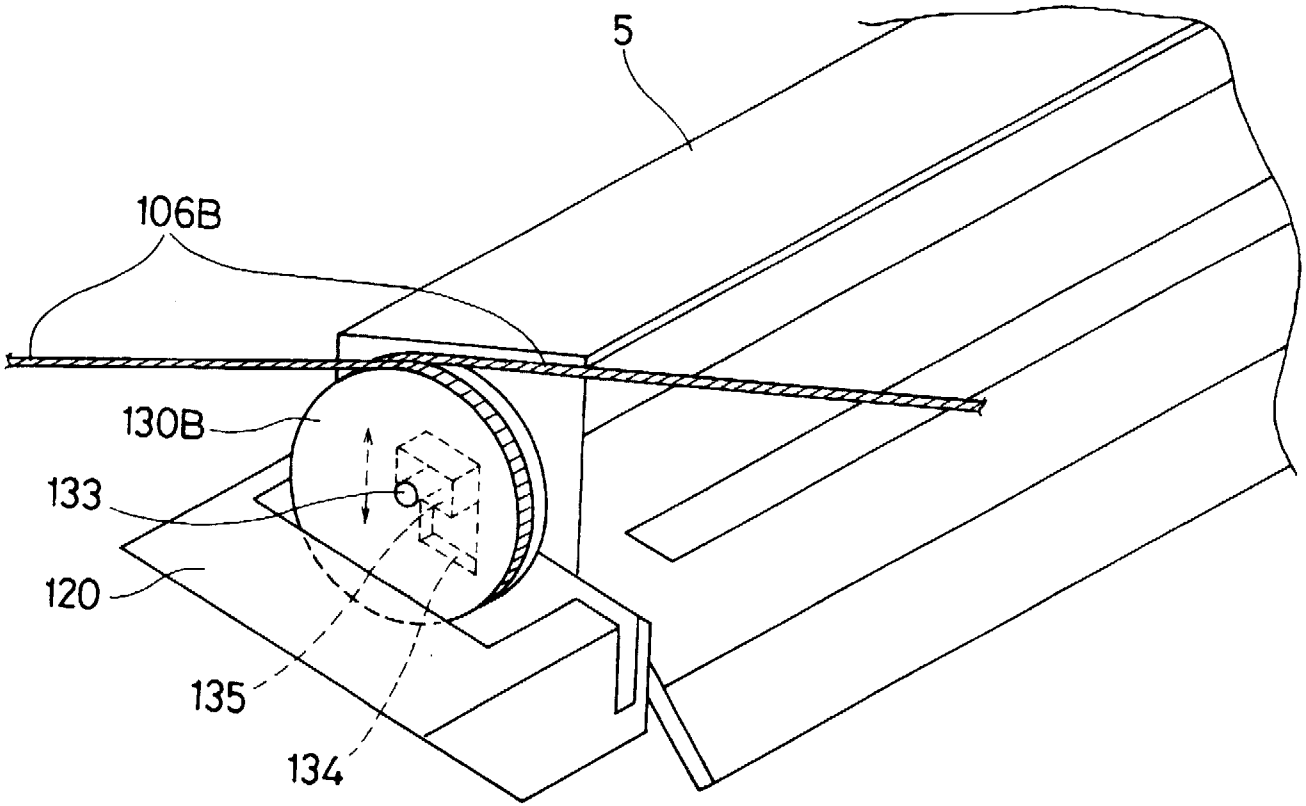
FIG. 6B is a view illustrative of the anchoring sections between the mirror unit 5 and driving means.
Figure 7:
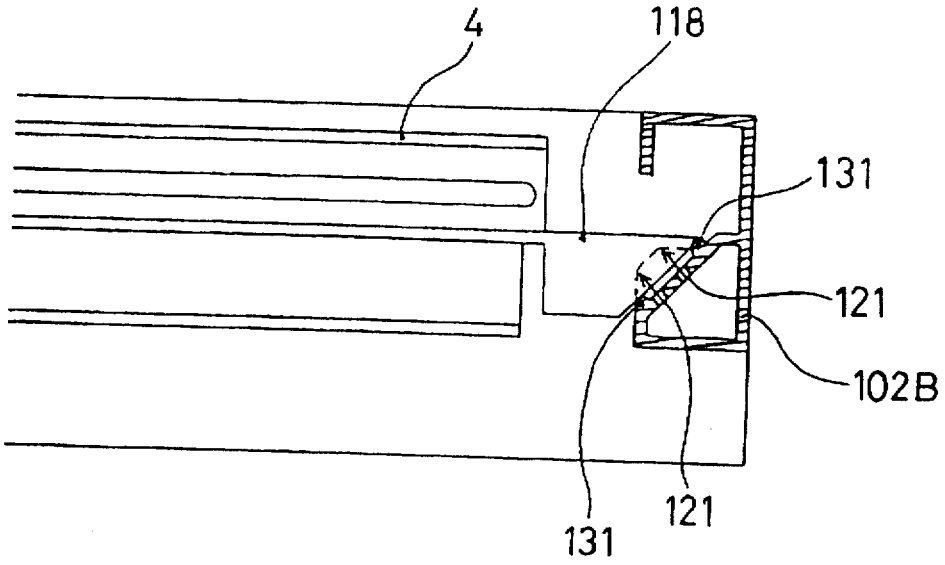
FIG. 7 is a view illustrative of the configuration of the air duct rail at its home position.

As mentioned above, the two-stepped pulleys 130A and 130 B are attached to the supporting blocks 119 and 120 at both ends of the mirror units 5, in a freely rotatable manner with respect to the mirror unit 5 and the supporting block 120. FIG. 6B illustrates the relationship among the mirror unit 5, the supporting block 120 therefor and the two-stepped pulley 130B. The mirror unit 5 is provided with an engaging member 135 (indicated by the broken line), as is the case with the mirror unit 4. The shaft 133 (indicated by the broken line) of the two-stepped pulleys 130*a* and 130B passes through the engaging member 135 to fix and support the two-stepped pulleys 130A and 130B. A rail groove 134 formed in the side of the mirror unit 5 is engaged with the engaging member 135 in such a manner that smooth movement of the rail groove 134 occurs only vertically (in the direction indicated by the broken double-headed arrow in FIG. 6B). The mirror unit 5 may be levitated like the mirror unit 4. Accordingly, when the mirror unit 5 is levitated, the rail groove 134 moves upward, and thus the engaging member 135 (and the shaft 133 passing through it as well) is maintained at a fixed position with respect to the drive wire 106B without being influenced by the levitation of the mirror unit 5. The engaging member 135 remains at the fixed position even after the mirror unit 5 has been released from the levitated state and has come down. This configuration results in no vertical load exerted from the drive wire 106B on the mirror unit 5 even while being levitated, and thus prevents the position of the mirror unit 5 in the direction of levitation from being unstable.

A pair of parallel tubular air duct rails 102A and 102B serving as air duct means are provided at both sides of the mirror units 4 and 5, extending along the direction of scanning, and air is supplied with motor fans 103A and 103B.

The air duct rails 102A and 102B each have an air-blowing surface 124 with a plurality of air spouts 121, located in such a manner as to face the air-receiving surfaces 122 of the mirror units 4 and 5. The air duct rails 102A and 102B have extensions over the longest possible scanning stroke for exposing and scanning, at the standby side (i.e., at the side of the motor fans 103A and 103B), and the extensions have air spouts 12 as well.

The air spouts 121 are designed to blow air toward the center of the original glass 9. The foregoing configuration is provided according to the invention, since the temperature of the surface of the original glass 9 most likely increases during the process of exposing and scanning, and thus air-cooling is required even while the mirror units 4 and 5 are on standby. In addition, in cases where the air duct rails 102A and 102B faces only up, if the mirror units 4 and 5 lean toward either of the air duct rails 102A and 102B, the mirror units undergo vibration due to the wires 106A and 106B, causing zigzag movement of the mirror units 4 and 5 in the direction of exposing and scanning, and this may result in disturbance of the image.

In contrast, with the air duct rails 102A and 102B designed to direct air flow toward the center of the original glass 9 according to the invention, the force of air is horizontally applied to the mirror units 4 and 5, and this serves to force back the mirror units 4 and 5 which have leaned or are leaning to either of the air duct rails 102A and 102B, preventing the units from leaning to either air duct rail.

Figure 13:
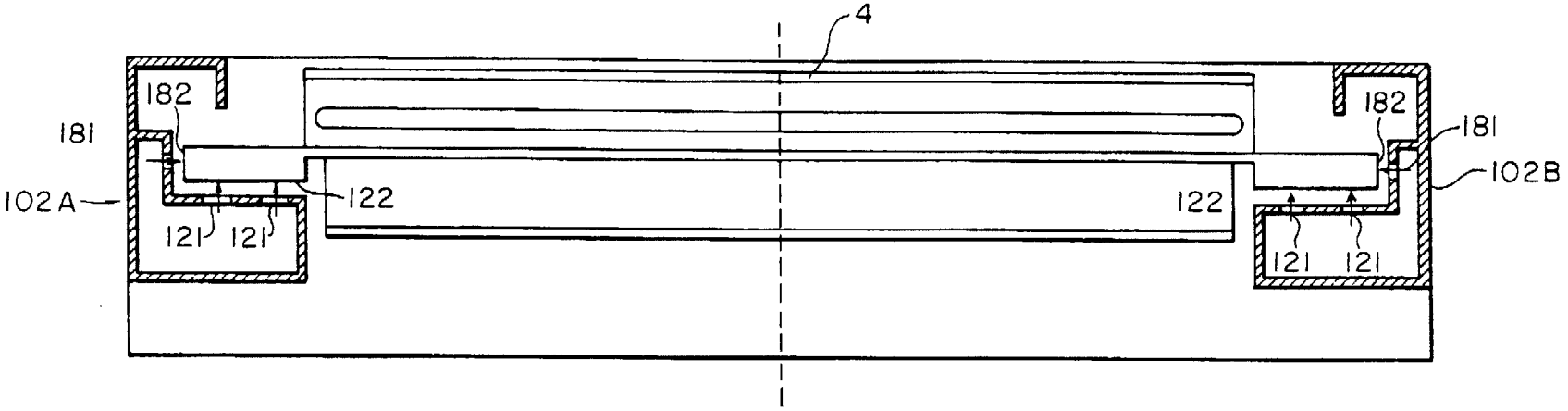
FIG. 13 is a schematic view illustrative of another embodiment of the document-exposing and -scanning apparatus according to the invention.

Alternatively, as shown in FIG. 13, the air duct rails 102A and 102B may be provided with additional air spouts 181 so as to allow blow air toward air-receiving surfaces 182 provided at the sides of the mirror units 4 and 5.

As a modification of the present embodiment, it is also possible to direct the flows of air blown through the air spouts 121 more upward than according to the present embodiment to cool the periphery rather than the center of the original glass 9 in a concentrated manner, or to create convex air-blowing surfaces 124, as described later, so as to allow blowing air not only along the original glass, but also out from the air duct rails 102*a* and 102B to thereby ensure an even flow of air throughout the exposing and scanning apparatus, thus preventing buildup of dust, etc.; in this way the flow of air may be controlled as desired by, for example, directing air toward places to be air-cooled, or by directly the air spouts toward where the air flow should be guided.

Figure 5:
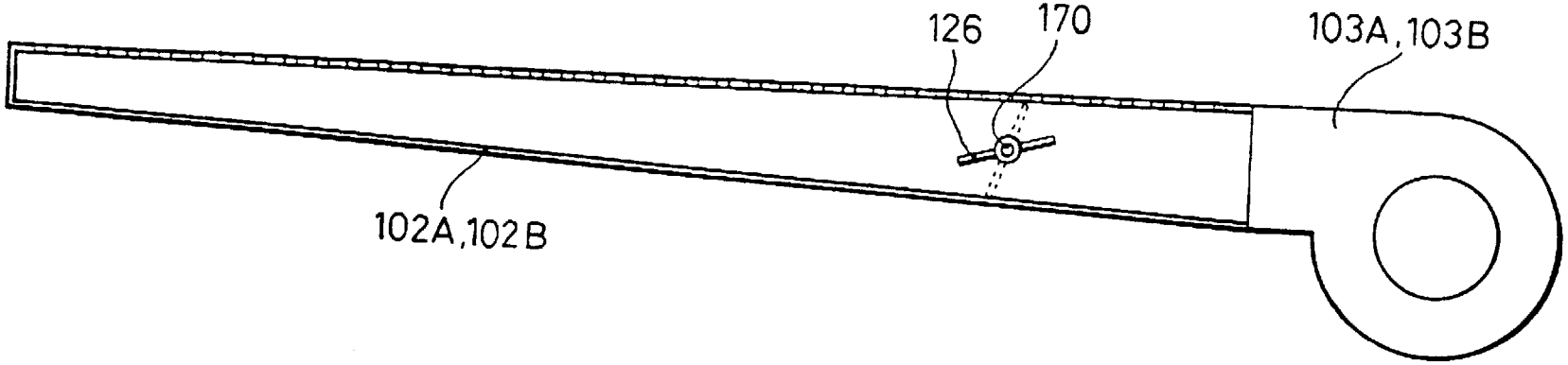
FIG. 5 is a detailed sectional view illustrative of a air duct rail according to the invention.

As shown in FIG. 5, a flow-adjusting blade 126 is provided inside each of the tubular air duct rails 102A and 102B in a rotatable manner around a supporting shaft 170. Adjustment of the angle of rotation of the supporting shaft 170 results in adjustment of the volume of air blown through each of the air duct rails 102A and 102B, and in adjustment of the standard air volume, and balances the volumes of air blown through the rails, 102A and 102B.

Figure 3:
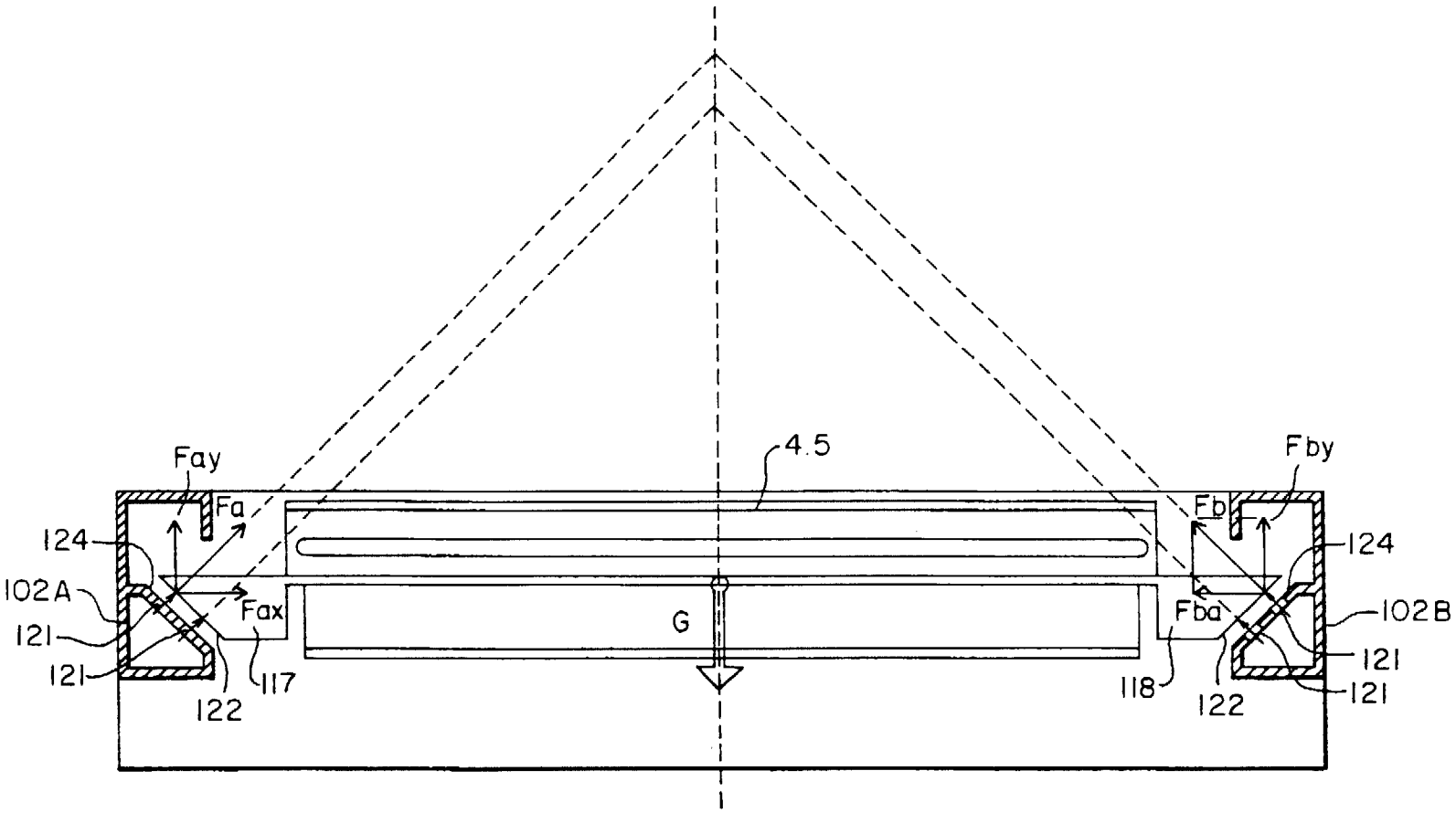
FIG. 3 is a section taken on line D—D' in FIG. 2 which illustrates a document-exposing and -scanning apparatus according to the invention.

FIG. 3 is a section taken on line D—D' in FIG. 2. As shown therein, the configuration is such that the air-blowing surfaces 124 of the air duct rails 102*a* and 102B point inwardly and upward in the optical system, and air is blown toward the air-receiving surfaces 122 of the mirror units 4 and 5, in such a manner that lines of direction of the air blown from the two sides indicated by dotted lines in the drawing cross on the vertical line across the center of gravity of the mirror units 4 and 5, thus controlling the air to be blown toward the center in directions perpendicular to the direction of scanning in the same volume and at the same pressure through the air spouts 121 of the air duct rails 102A and 102B.

With this configuration, vertical components Fay and Fby and horizontal or center-orientated components Fax and Fbx of the forces exerted on the air-receiving surfaces 122 of the mirror units 4 and 5 are at the same levels, respectively, at both ends of the mirror units 4 and 5. Here, since the design is such that the resultant force of the vertical components Fax and Fby is greater than the gravity C exerted on the center of gravity of the mirror units 4 and 5, and the horizontal components Fax and Fbx of the forces are equal to each other, the mirror units 4 and 5 are levitated in the center, stabilized in the direction normal to the direction of scanning. In addition, efficient cooling may be accomplished by blowing air directly over a wide range in the optical system, including the original glass, etc.

Furthermore, the flow velocity of blown air may be increased by decreasing the aperture of the air spouts 121 of the air duct rails 102A and 102B, and this results in increase in the forces Fa and Fb exerted on the air-receiving surfaces 122. An even increase in the number of the air spouts 121 through the air-blowing surfaces 124 results in increase in the forces Fa and Fb exerted on the air-receiving surfaces 122 as well. The aperture and the number of the air spouts 121 may be appropriately determined based on the output of the motor fans which supply air.

Figure 10A:
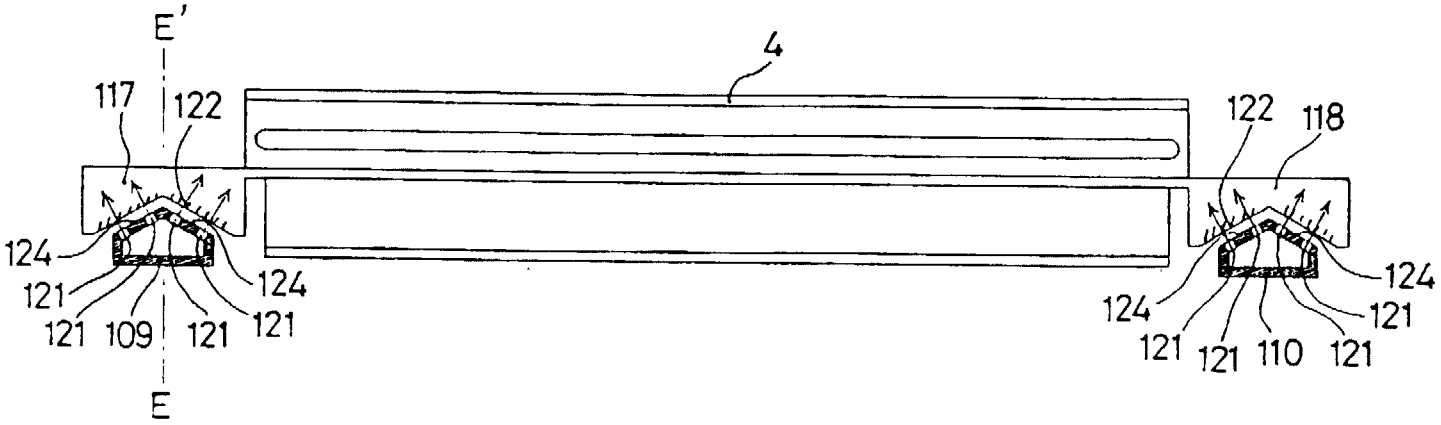
FIG. 10A is a sectional view illustrative of the convex-section air duct rails according to the invention.
Figure 10B:
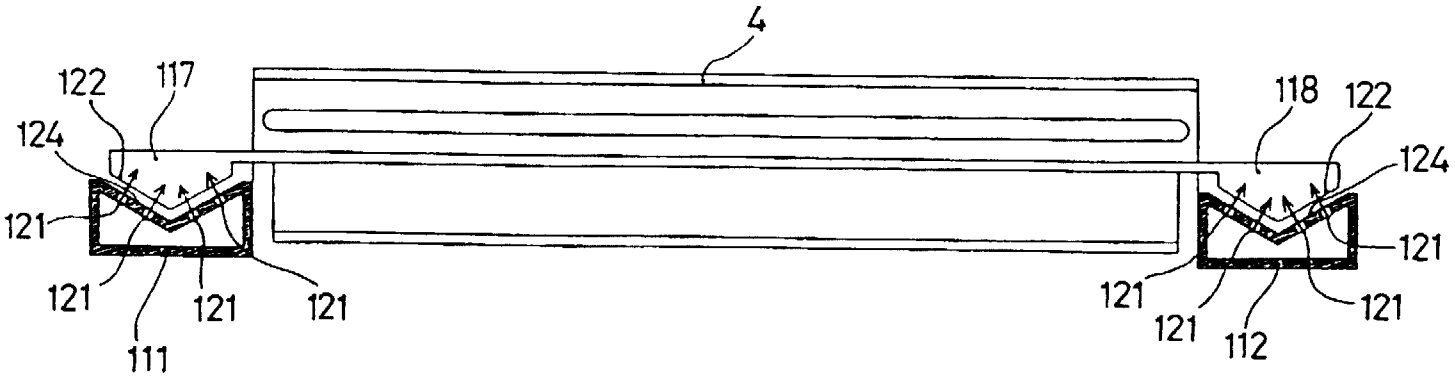
FIG. 10B is a sectional view illustrative of the concave-section air duct rails according to the invention.

Alternatively, as shown in FIGS. 10(A) and 10(B), the air duct rails may have a convex in cross section as indicated by 109 and 110 or a concave cross section as indicated by 111 and 112, and the air-receiving surfaces 122 of the mirror units 4 and 5 may be shaped so as to match the air duct rails 109 and 110, or 111 and 112. Particularly, the air spouts 121 are arranged along the air duct rails 109 and 110, or 111 and 112, symmetrically with respect to the vertical center lines (e.g., line E—E' in FIG. 10(A)). Since this configuration serves to cancel the horizontal forces of action exerted on the mirror units 4 and 5 while the mirror units 4 and 5 are levitated, and thus the levitated mirror units 4 and 5 are kept stable in a horizontal direction, the configuration can be a satisfactory alternative to the embodiment described above wherein the directions of air blown from the two sides intersect on the vertical line across the center of gravity. In FIG. 10, the hatched areas represent cross sections of the air duct rails.

Figure 4A:
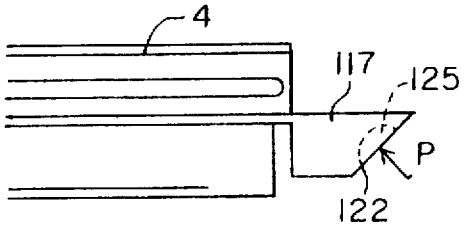
FIG. 4A is a partially sectional view illustrative of part of the mirror unit in the vicinity of its supporting block.
Figure 4B:
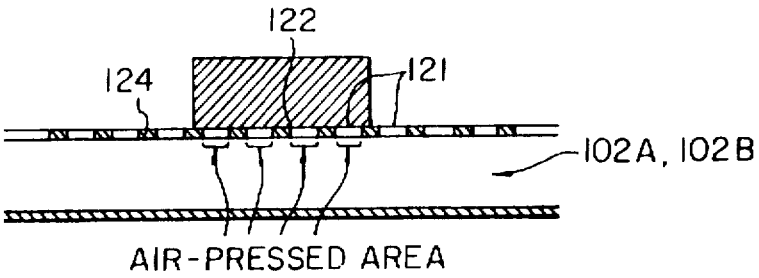
FIG. 4B is a view illustrative of a relationship between the air-acting surfaces of the mirror unit and the air duct rails.
Figure 4C:
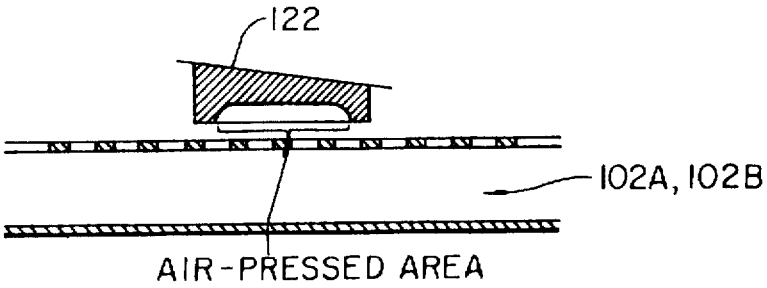
FIG. 4C is a view illustrative of another relationship between the air-acting surfaces of the mirror unit and the air duct rails.
Figure 14A:
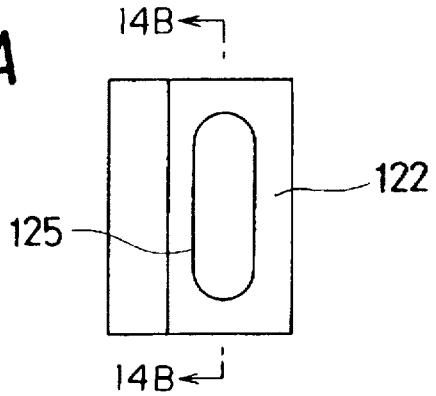
FIG. 14A is a front view illustrative of the air-interactive surfaces of the mirror units when viewed from the direction indicated by "p" in FIG. 4A.
Figure 14B:
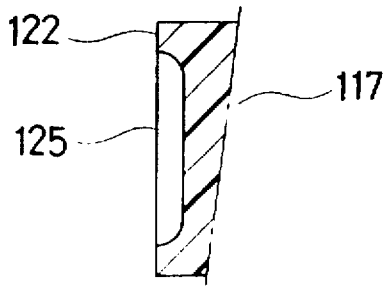
FIG. 14B is a sectional view illustrative of the supporting blocks and the air-interactive surfaces, taken on line Q—Q' in FIG. 14A.

Each of the air-receiving surfaces 122 of the mirror units 4 and 5 has a recess 125, as indicted by a dotted curve in FIG. 4(A). The front view of the recess 125 when viewed from the direction indicated by "p" in the drawing is illustrated in FIG. 14A, and the section taken on line Q—Q' in FIG. 14(A) is illustrated in FIG. 14B. The recesses 125 help the mirror units 4 and 5 on standby for exposing and scanning to be levitated over the air duct rails 102A and 102B. This is because the air-receiving surfaces 122 without the recesses 125 are brought into intimate contact with the air-blowing surfaces 124, as shown in FIG. 4(B), and thus the air-receiving surfaces 124 are pressed by the air only along sections covering the air spouts 121, whereas the provision of the recesses 125 results in higher areas of the pressed sections of the air-receiving surfaces, as shown in FIG. 4(*c*).

In addition, as shown in FIG. 5, the cross sectional areas of the air duct rails 102A and 102B gradually decrease as their distances from the motor fans 103A and 103B increase. This results in a uniform flow velocity of the air along the entire lengths of the air duct rails 102A and 102B, a uniform volume of the air blown through the air spouts 121 per unit area, a uniform air pressure applied along the entire surfaces of the air duct rails 102A and 102B, and further a uniform force of action of air which the mirror units 4 and 5 receive along the entire length of scanning along the air duct means.

Figure 12:
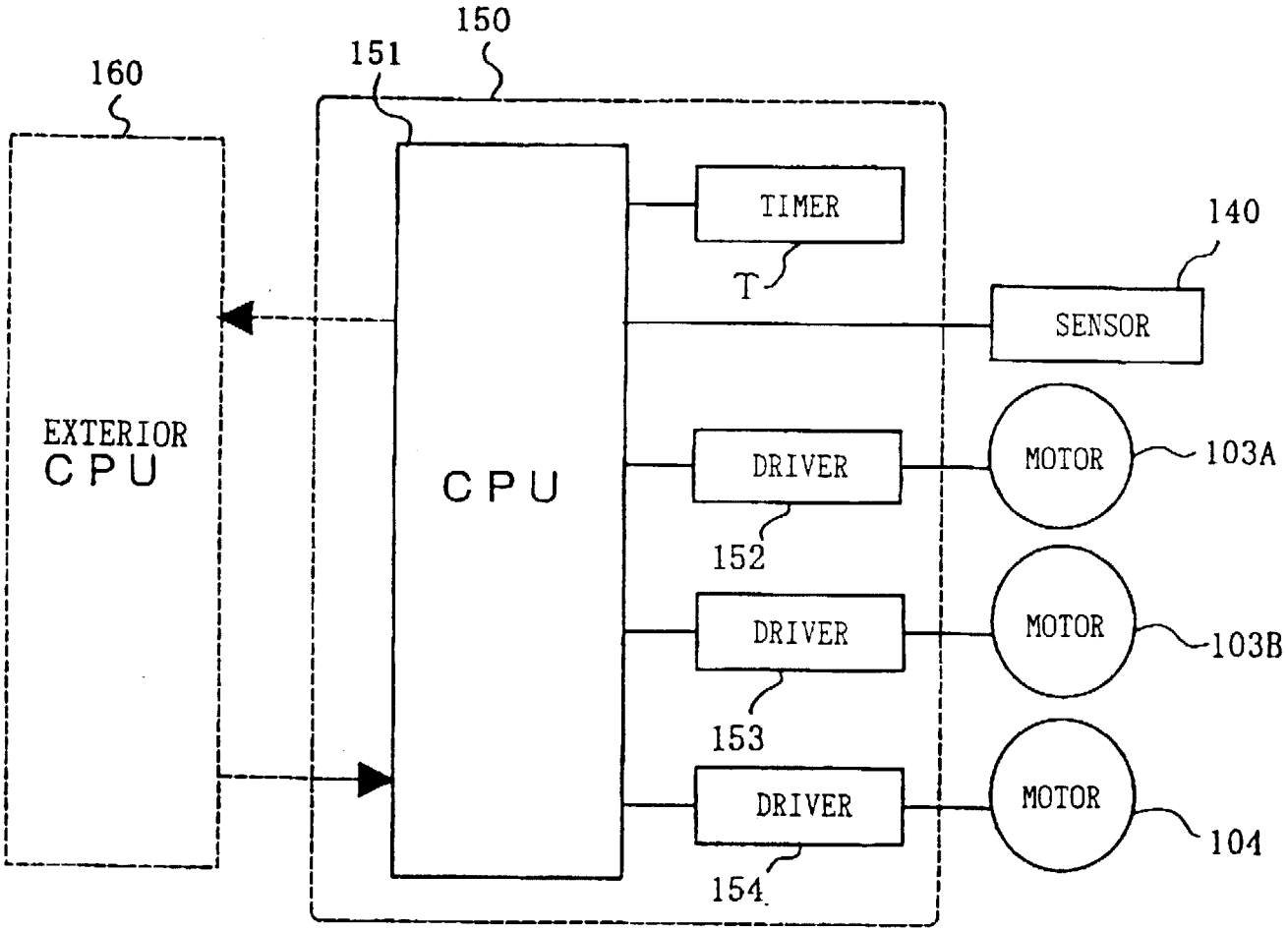
FIG. 12 is a block diagram illustrative of a control section in the document-exposing and -scanning apparatus according to the invention.

FIG. 12 is a block diagram illustrative of the controller, wherein a control section 150 comprises a CPU 151, drivers 152, 153 and 154 for activating the respective motors, and a timer T. The CPU 151 forms images through two-way communication with an exterior CPU 160 which controls the image-forming apparatus in use. The control section 150 is connected with a levitation height sensor 127, and functions to detect whether the mirror units 4 and 5 are located at their home positions, to activate the fan motors 103A and 103B through the drivers 152 and 153 upon receipt of image-forming signals from the image-forming apparatus and to activate the drive motor 104 as illustrated in the flow chart in FIG. 8 about which a description will be given later, so that the mirror units 4 and 5 move for exposing and scanning.

Figure 8:
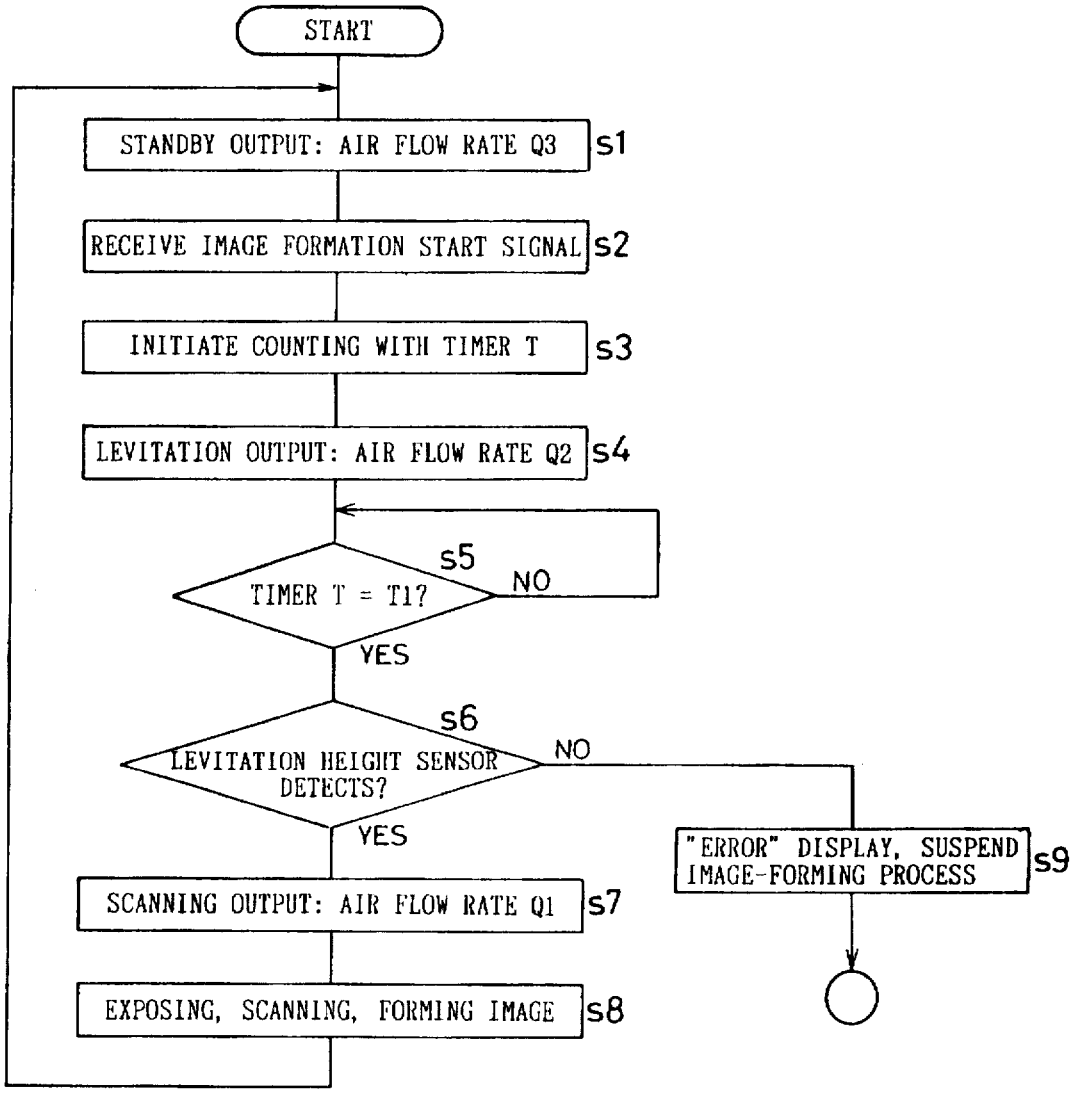
FIG. 8 is a flow chart illustrative of the operation of the document-exposing and -scanning apparatus according to the invention.

The operation of the image-forming apparatus according to the invention will now be explained with reference to the flow chart in FIG. 8. At first, the mirror units 4 and 5 are on standby at their home positions shown in FIG. 2, and the respective motor fans 103*a* and 103B operate with a first output. At this point of time, the mirror units 4 and 5 are placed in contact with the air duct rails 102A and 102B, and air is blown through the air duct rails 102A and 102B at a flow rate Q3 (step S1). This accomplishes effective cooling and controls the noise level of the motor fans 103A and 103B during standby.

When the operator operates a key of the operation panel (not shown) to generate an image formation start signal, the standby image-forming apparatus initiates formation of an image (step S2).

Upon receiving the image formation start signal, the control section 150 first resets the built-in timer T to initiate counting (step S3). Concurrently, the respective motor fans 103A and 103B are activated with a second power higher than the first power in order to shorten the time required for their levitation. This results in blowing of air through the air duct rails 102A and 102B at a flow rate Q2 greater than the flow rate Q3 (step S4).

Since the design is such that the air flow rate Q2 is higher than the flow rate Q1 when the mirror units 4 and 5 are levitated for exposing and scanning, which is described later, the mirror units 4 and 5 are instantaneously levitated off the air duct rails 102A and 102B.

After a predetermined time T1 has passed since the initiation of counting with the timer T (step S5), the control section 150 checks information detected by the levitation height sensors 127 provided at the supporting blocks 117, 118, 119 and 120 at both ends of the respective mirror units 4 and 5 (step S6). When the information indicates no levitation, assuming that the mirror units 4 and 5 have not been levitated, it is judged that an error has occurred in the document-exposing and -scanning apparatus, and the operation of the image-forming apparatus has been suspended, and the word "ERROR" is displayed (step S9). On the other hand, in cases where the information indicates levitation, assuming that the mirror units 4 and 5 have been levitated, it is judged that the document-exposing and -scanning apparatus have operated normally, and the process proceeds to the next step for control of the operation.

The control section 150 then activates the respective motor fans 103A and 103B with a third power which is higher than the first power, but lower than the second power. This results in blowing of air through the air duct rails 102A and 102B at a flow rate Q1 which is higher than the flow rate Q3, but lower than the flow rate Q2 (step S7). This air flow rate Q1 is set to cause levitation of the mirror units 4 and 5 at predetermined distances from the air duct rails 102A and 102B. Here, the control section 150 checks the information detected by the levitation height sensors 127; when no levitation is detected, the power to the respective motor fans 103A and 103B is increased, and after a predetermined time the information detected by the levitation height sensors 207 is again checked. When levitation is detected, the control means 150 activates the drive motor 104 for reciprocating movement of the mirror units 4 and 5 to expose a document on the original glass to form an image on a sheet (steps S6–S8). The process returns to the initial condition after the image has been formed.

In order to design the image-forming apparatus according to the invention as an apparatus with a short first-copy time, i.e. the time required for producing a first image, the air duct rails 102A and 102B may be provided with supporting protrusions 131 to support the mirror units 4 and 5 in such a manner that the mirror units 4 and 5 located at their home positions on standby are positioned at the same levels as those of the mirror units 4 and 5 levitated from the air duct rails 102*a* and 102B. More specifically, with the mirror units 4 and 5 on standby, but already located at the same levels as the levitation height thereof for exposing and scanning, the process for exposing and scanning starts, and the mirror units 4 and 5 receive air at the flow rate Q1 for exposing and scanning when they move past the supporting protrusions 131, at positions at a predetermined height of levitation. This allows quick exposing and scanning with the mirror units 4 and 5 at the flow rate Q1, without switching to the flow rate Q2 for levitation.

In order to provide an alternative to the apparatus with a short first-copy time, the air flow rate Q3 to the mirror units 4 and 5 on standby for the operation may be set so as to place the mirror units 4 and 5 off the air duct rails 102A and 102B, at levels lower than the levitation heights for exposing and scanning in a non-contact state. This also eliminates the necessity of switching to the flow rate Q2 for levitating the mirror units 4 and 5 still on standby, and thus exposing and scanning with the mirror units 4 and 5 may be carried out rapidly.

Figure 9:
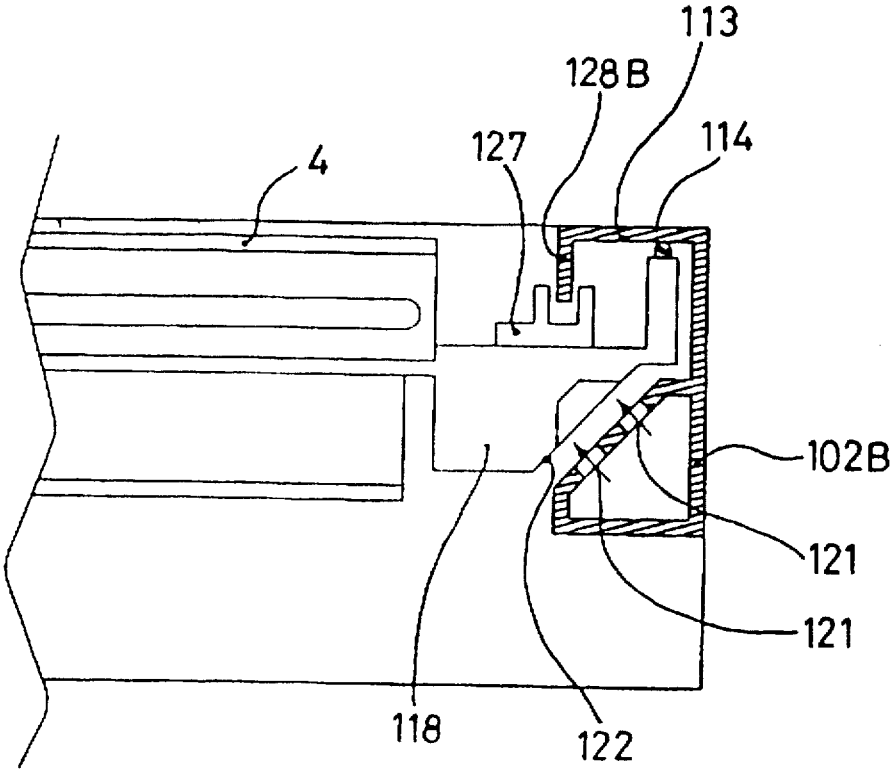
FIG. 9 is a view illustrative of the levitation-regulating means according to the invention.

FIG. 9 is a view illustrative of a second embodiment according to the invention. Regulating members 113 for regulating the greatest levitation height of the mirror units 4 and 5 are provided along the direction of exposing and scanning with the mirror units 4 and 5, opposing the air duct rails 102A and 102B, and the mirror units 4 and 5 are provided with slide members 114 made of an easily slidable material which face the regulating members 113. The mirror units 4 and 5 are levitated by the action of air blown through the air duct rails 102A and 102B, and exposing and scanning are carried out, with the regulating members 113 placed in contact with the slide members 114.

Unlike conventional mirror units which are brought into contact with the rails for exposing and scanning, since the apparatus according to the embodiment is designed in such a manner that the mirror units are not weighted on the sections of contact, less pressure is exerted on the sections of contact. This solves not only the problem of vertical movement of the mirror units 4 and 5 over the acceptable limits due to uneven supply of air which results from different capabilities of the respective motor fans 103A and 103B and blowing position-dependent unevenness of air flow due to a variety of loss, but also the problem of forming distorted images, and causing noise during scanning and wear of sections of contact, etc.

Figure 11:
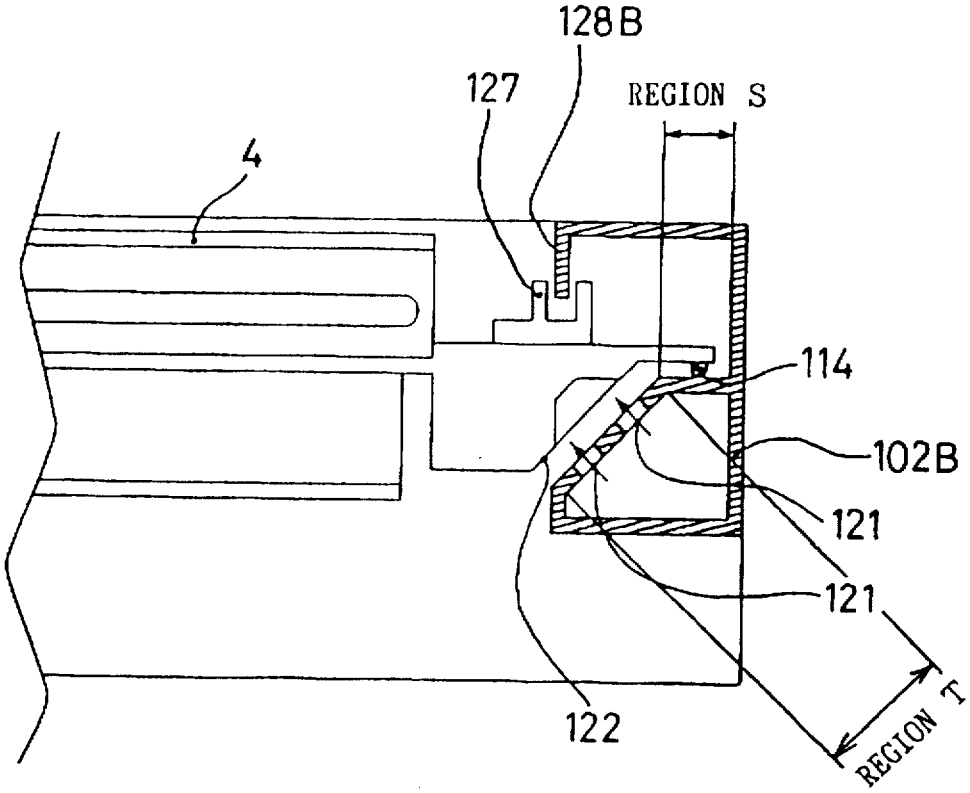
FIG. 11 is a partially schematic view illustrative of a lower vertical drag type of the document-exposing and -scanning apparatus according to the invention.

Alternatively, according to a third embodiment which produces the same effects as the second embodiment, as shown in FIG. 11, the air duct rails **102*a* and 102B may comprise regions S without air spouts and regions T with air spouts along the direction of scanning, with slide members 114 provided on the mirror units 4 and 5 in contact with the air spout-free regions E. Preferably, the slide members 114** are made of an easily slidable material (LURON; a resin manufactured by NTN, Inc.).

According to the third embodiment, air is blown through the air spout-provided regions T, and acts on the air-receiving surfaces 122 of the mirror units 4 and 5 to relieve the vertical drag of gravity of the mirror units 4 and 5 which is exerted on the air duct rails 102A and 102B via the slide members 114. This reduces the frictional resistance of the mirror units 4 and 5 during the process of exposing and scanning, and reduces image deformation due to zigzag movement of the mirror units 4 and 5, noises during scanning and wear of the slide material. In addition, since air is blown through the plurality of the air spouts formed through the surfaces of the air duct rails 102A and 102B facing the mirror units 4 and 5, the inside of the apparatus is effectively cooled as well.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and the range of equivalency of the claims are therefore intended to be embraced therein.

What is claimed is:

1. A document-exposing and -scanning apparatus comprising:

a document-laying table for mounting a document thereon; an optical scanning section comprising exposing and scanning means which exposes and scans the document on the document-laying table and is provided with air-receiving surfaces, and drive means for reciprocating the exposing and scanning means in the direction of scanning; and air duct means placed facing the air-receiving surfaces of the exposing and scanning means so as to subject the surfaces to the action of air, extending along the direction of scanning, wherein air is blown through the air duct means to levitate the exposing and scanning means while being directed to the optical scanning section as well.

2. The document-exposing and -scanning apparatus according to claim 1, wherein the air duct means is constructed of at least two parallel air ducts placed near both ends of the exposing and scanning means, with the ducts being placed so as to blow air in slanting, inward and upward directions in a converging manner.

3. The document-exposing and -scanning apparatus according to claim 1, wherein the air duct means has concave or convex sections, and is provided with air spouts formed through the concave or convex surfaces, and the exposing and scanning means has sections matching the concave or convex contour of the air duct means.

4. The document-exposing and -scanning apparatus according to claim 1, wherein the air duct means has additional air spouts for blowing air toward both ends of the exposing and scanning means on the sides thereof.

5. The document-exposing and -scanning apparatus according to claim 1, wherein the air duct means is provided with regulating members, which extend along the direction of scanning, to regulate the greatest levitation height of the exposing and scanning means, and the exposing and scanning means undergoes reciprocating motion while part of the exposing and scanning means is placed in contact with the regulating members.

6. The document-exposing and -scanning apparatus according to claim 1 or claim 4, wherein each of the air duct means is tubular, and is provided with an adjusting blade for changing the internal air flow area.

7. The document-exposing and -scanning apparatus according to claim 1 or claim 4, wherein the exposing and scanning means is levitated independently from the driving means.

8. The document-exposing and -scanning apparatus comprising:

a document-laying table for mounting a document thereon; an optical scanning section comprising exposing and scanning means which exposes and scans the document on the document-laying table and is provided with air-receiving surfaces, and drive means for reciprocating the exposing and scanning means in the direction of scanning; and air duct means placed facing the air-receiving surfaces of the exposing and scanning means so as to subject the surfaces to the action of air, extending along the direction of scanning, wherein the air duct means is formed of a first region for blowing air and a second smooth region on which part of the exposing and scanning means slide, air blown through spouts arranged in the first region of the air duct means acts on the air-receiving surfaces of the exposing and scanning means, the exposing and scanning means undergoes reciprocating motion while part of the exposing and scanning means is placed in contact with the second region, and air blown through the air duct means is directed to the optical scanning section.

* * * * *